United States Patent [19]

Andersson

[11] 4,068,816

[45] Jan. 17, 1978

[54] SUPPORT ASSEMBLY

[75] Inventor: Karl Gunnar Andersson, Handen, Sweden

[73] Assignee: Friktions-Stamp AB, Sweden

[21] Appl. No.: 747,075

[22] Filed: Dec. 2, 1976

[51] Int. Cl.[2] ..... A47H 1/14

[52] U.S. Cl. ..... 248/251

[58] Field of Search ..... 211/105.1, 105.3, 105.4; 248/57, 201, 241, 251, 264, 268, 351, 354 R, 354 S, 357

[56] References Cited

U.S. PATENT DOCUMENTS

| | | | |
|---|---|---|---|
| 1,235,476 | 7/1917 | Hoff | 248/251 |
| 2,661,850 | 12/1953 | Fowler et al. | 211/105.4 |
| 2,964,276 | 12/1960 | Silverthorne | 248/201 |
| 3,521,758 | 7/1970 | Guilfoyle | 248/354 S X |

FOREIGN PATENT DOCUMENTS

| | | | |
|---|---|---|---|
| 537,706 | 7/1941 | United Kingdom | 211/105.4 |

*Primary Examiner*—James C. Mitchell

[57] ABSTRACT

Assembly for mounting a cross bar by compression between two opposite walls including two end parts each having a U-shaped yoke to embrace the associated end of the cross bar. One of the end parts has fixed pegs to engage the associated wall, and the other end part has threaded clamping bolts to be screwed against the other wall to clamp the support assembly to the walls by axial compression forces through the cross bar.

9 Claims, 5 Drawing Figures

SUPPORT ASSEMBLY

The present invention relates to a support assembly, to be clamped between two opposite walls, for instance in order to receive a vertical load transverse to the assembly.

In order to support working platforms in ventilation shafts or lift shafts, or shuttering, in casting landings and stairs, the known technique has been to build up scaffolds in the shafts and the staircases. These scaffolds, which comprise a framework, for instance of tubes, are time consuming to install and usually at least two persons are required for the work. Moreover, scaffolds of this type are rather expensive to rent. The time for building up and taking down the scaffolds as well as the renting costs substantially affect the costs of these kinds of casting or mouldind operations.

According to one aspect of the invention, a support assembly for mounting a crossbar between two walls includes a pair of end parts each including a plate, one surface of which is provided with a U-shaped yoke, the web of which forms a support for the crossbar and the legs of which form lateral supports for said crossbar, one plate being provided with fixed pegs to rest against one of the walls, while the other plate is provided with throughgoing threaded clamping bolts adapted to be screwed against the other wall.

In one embodiment, the said other plate carries nuts to receive the clamping bolts and the nuts are rigidly connected to the surface of the plate which is arranged to face the other wall. In order to provide firm contact with the walls both the pegs and the clamping bolts may be formed with pointed ends.

The invention may be carried into practice in various ways but one specific embodiment of the invention will now be described by way of example with reference to the accompanying drawings, in which.

Figure 1:
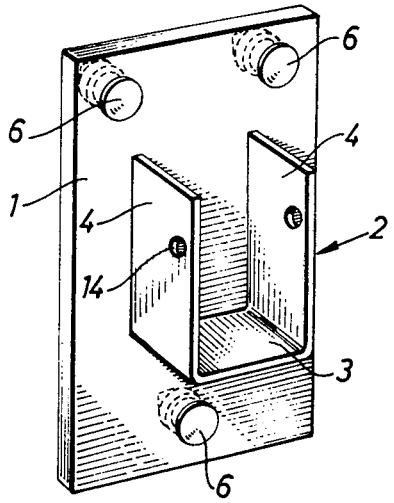
FIG. 1 is a perspective view of one bracket.
Figure 2:
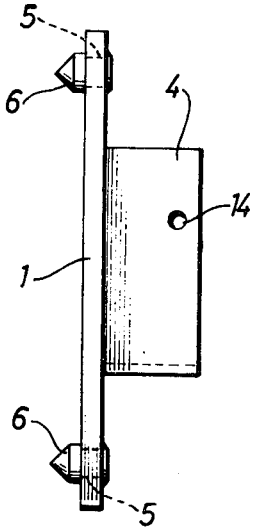
FIG. 2 is a side view of the bracket shown in FIG. 1.

FIGS. 1 and 2 illustrate a bracket which comprises a rectangular plate 1, to which a U-shaped yoke 2 is welded. The U-shaped yoke is adapted to serve as a supporting element for a beam or crossbar, for instance of wood, whereby the bottom 3 of the yoke carries the crossbar while its legs 4 serve as lateral supports therefor. The lateral supports are provided with holes 14 to make it possible to fasten the bracket to the crossbar by means of nails or the like. In the rectangular plate 1 there are three holes 5, in which pegs 6 are riveted.

Figure 3:
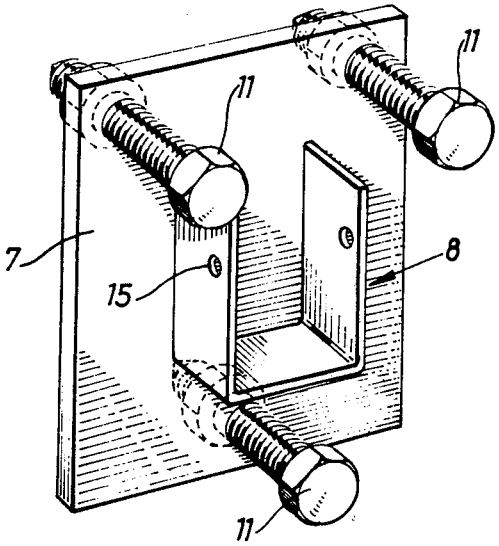
FIG. 3 is a perspective view of a second, adjustable, bracket.
Figure 4:
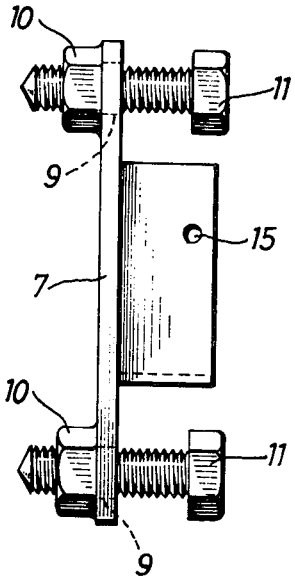
FIG. 4 is a side view of the adjustable bracket of FIG. 3.

FIGS. 3 and 4 show an adjustable bracket which also comprises a rectangular plate 7, with a supporting yoke 8 for the other end of the crossbar. The supporting yoke is designed in the same way as those of the first bracket and is provided with holes 15 for fastening the bracket to the crossbar. The plate 7 is also provided with three holes 9, and on the back of the plate nuts 10 are welded concentrically with the holes 9 and serve as mounting members for threaded clamping bolts 11.

Figure 5:
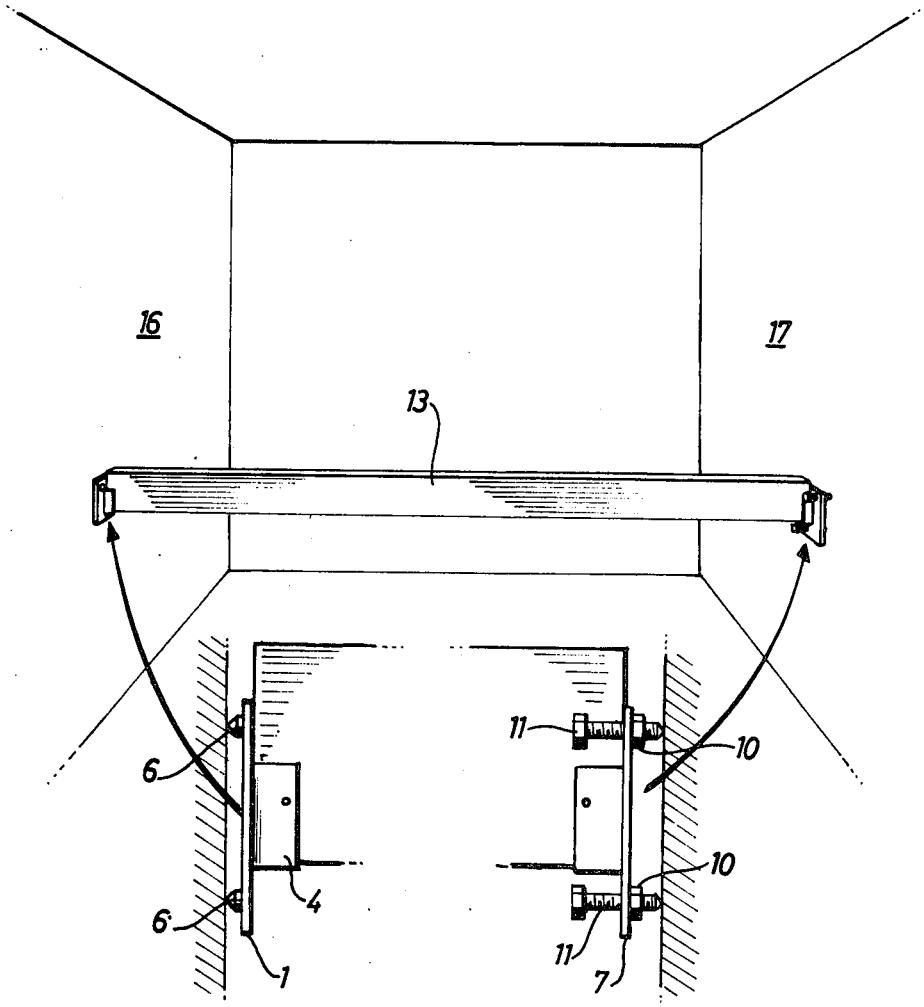
FIG. 5 is a sketch showing the brackets clamped employed to support a beam or crossbar between two walls in a shaft.

FIG. 5 shows a crossbar 13 being clamped between two opposite walls in a shaft by means of the two brackets. One condition for gaining the technical advance according to the invention and absorbing forces in the transverse direction of the crossbar is that the two parts are clamped against a relatively inelastic material such as concrete or steel. In order to keep the clamping force constant, the elastic properties of the material must be such that no movement takes place after clamping.

The mounting of the support assembly according to the present invention can easily be effected by one person in the following way. The crossbar is cut to a suitable length, which is the distance between the shaft walls minus the thickness of the parts 1, 6, 7, 10 and a short length of bolt 11. The plates 1 and 7, respectively, are then fastened to each end of the crossbar 13 by means of nails through the holes 14 and 15 in the U-shaped yokes. The brackets and crossbar are now held in such a position that the fixed plate 1 is placed against one of the shaft walls 16, whereafter the clamping bolts 10 are screwed by hand against the other shaft wall 17 when the crossbar has been correctly positioned. When the assembly is lightly mounted, the position is adjusted, and then the clamping bolts are fastened with a ratchet wrench. When the clamping bolts are firmly tightened the pegs 6 in the first shaft wall 16 are struck with a hammer so that their pointed ends enter the wall 16 slightly, whereafter the clamping bolts are re-tightened as much as possible. The clamping bolts are suitably greased with graphite grease or the like in order to reduce the friction between the plate 7 and the bolts.

As is previously mentioned the bracket assembly according to the invention can suitably be used as a support, for instance for inner moulds or shuttering in the casting of shaft walls; protective platforms in shafts; working platforms for lift mechanics; working platforms in ventilation shafts; moulds in casting of landings and stairs, shaping of lift door frames and moulds in casting smaller vaults. Furthermore, it can be used to cover temporary openings in vaults during building.

What I claim is:

1. A support assembly for mounting a crossbar between two opposite walls, including a pair of end parts each including a plate, one surface of each of said plates being provided with a U-shaped yoke, the bottom web of said yoke forming a vertical support for the associated end of the crossbar and the legs of said yoke forming lateral supports for the associated end of said crossbar, one plate being provided with fixed pegs to rest against one of the walls, the other plate being provided with throughgoing threaded clamping bolts adapted to be screwed against the other wall, said pegs and said clamping bolts being generally aligned parallel to the longitudinal axis of said crossbar and being operable to clamp the entire support assembly to the opposite walls by axial compression forces through the crossbar.

2. An assembly as claimed in Claim 1 in which the said other plate carries nuts to receive the clamping bolts and the nuts are rigidly connected to the surface of the plate which is arranged to face the other wall.

3. An assembly as claimed in Claim 1 or wherein the pegs and the clamping bolts are formed with pointed ends for engaging the walls.

4. The combination with an assembly as claimed in claim 1 of a crossbar made of wood.

5. A support assembly including a crossbar arranged to extend between two opposite walls and a pair of end brackets each having a plate of larger area than the cross section of the crossbar and a U-shaped yoke secured to one side of the plate to afford a generally horizontal web for supporting the crossbar with an end thereof in abutment with the plate and a pair of generally vertical webs for laterally locating the crossbar, one plate being provided, on its side opposite to that having the yoke, with fixed pegs for abutting one of said walls, and the other plate being provided with threaded clamping bolts adapted to be screwed against the other wall.

6. A support assembly as claimed in claim 1 wherein the crossbar comprises a part of the combination and said crossbar is rectangular in cross-section with the larger dimension of said rectangular cross-section being arranged vertically.

7. A support assembly as claimed in claim 6 wherein said crossbar consists essentially of wood.

8. A support assembly as claimed in claim 7 wherein the vertical dimension of said crossbar is greater than the dimension from the bottom web of said U-shaped yoke to the top edge of the associated plate for each of said end parts so that the compressive stress of clamping is substantially concentrated in the bottom edge portion of said crossbar.

9. A support assembly as claimed in claim 8 wherein means is provided within the legs of each of said yokes for attachment to the associated end of said crossbar to maintain said end parts attached to said crossbar prior to clamping the assembly to the opposite walls.

* * * * *

UNITED STATES PATENT AND TRADEMARK OFFICE

CERTIFICATE OF CORRECTION

PATENT NO. Patent No. 4,068,816

DATED : January 17, 1978

INVENTOR(S) : Karl Gunnar Andersson

It is certified that error appears in the above-identified patent and that said Letters Patent are hereby corrected as shown below:

Column 1, line 18, "mouldind" should read --moulding--.

Column 2, line 59, cancel "or".

Signed and Sealed this

Ninth Day of May 1978

[SEAL]

Attest:

RUTH C. MASON
Attesting Officer

LUTRELLE F. PARKER
Acting Commissioner of Patents and Trademarks